US006293197B1

(12) United States Patent
Ray et al.

(10) Patent No.: US 6,293,197 B1
(45) Date of Patent: Sep. 25, 2001

(54) HYDROPHILIZED SUBSTRATE FOR PLANOGRAPHIC PRINTING

(75) Inventors: Joanne Ray; Greg Turner, both of Leeds; John Hearson, Normanton; Denise Howard, Sherburn-In-Elmet, all of (GB)

(73) Assignee: Kodak Polychrome Graphics, Norwalk, CT (US)

( * ) Notice: Subject to any disclaimer, the term of this patent is extended or adjusted under 35 U.S.C. 154(b) by 0 days.

(21) Appl. No.: 09/375,643

(22) Filed: Aug. 17, 1999

(51) Int. Cl.[7] ..... B41N 3/03; B41N 1/08
(52) U.S. Cl. ..... 101/455; 101/458; 101/459
(58) Field of Search ..... 101/453, 454, 101/455, 456, 458, 459, 463.1, 465–467; 430/302

(56) References Cited

U.S. PATENT DOCUMENTS

| | | | | |
|---|---|---|---|---|
| 2,714,066 | | 7/1955 | Jewett et al. | 101/456 |
| 3,181,461 | | 5/1965 | Fromson | 101/456 |
| 3,470,013 | | 9/1969 | Wagner | 101/453 |
| 3,640,221 | | 2/1972 | Wyke | 101/453 |
| 3,963,594 | | 6/1976 | Brasko | 204/129.95 |
| 3,971,660 | * | 7/1976 | Staehle | 101/460 |
| 4,052,275 | | 10/1977 | Gumbinner et al. | 204/129.95 |
| 4,072,589 | | 2/1978 | Golda et al. | 204/129.4 |
| 4,131,518 | | 12/1978 | Fromson | 204/38 A |
| 4,268,609 | | 5/1981 | Shiba et al. | 430/271 |
| 4,330,605 | | 5/1982 | Boston | 430/14 |
| 4,420,549 | | 12/1983 | Cadwell | 430/158 |
| 4,457,971 | | 7/1984 | Caldwell | 428/323 |
| 4,542,089 | | 9/1985 | Cadwell | 430/276 |
| 4,567,131 | | 1/1986 | Watkiss | 430/309 |
| 5,171,650 | | 12/1992 | Ellis et al. | 430/20 |
| 5,254,421 | * | 10/1993 | Coppens et al. | 101/465 |
| 5,345,869 | * | 9/1994 | Treverton et al. | 101/456 |
| 5,402,725 | * | 4/1995 | Vermeersch et al. | 101/460 |
| 5,501,150 | * | 3/1996 | Leenders et al. | 101/466 |
| 5,881,645 | | 3/1999 | Lenney et al. | 101/463.1 |
| 5,927,207 | * | 7/1999 | Ghosh et al. | 101/457 |
| 6,050,193 | * | 4/2000 | DeBoer et al. | 101/462 |
| 6,071,369 | * | 6/2000 | Vermeersch et al. | 101/458 |
| 6,105,500 | * | 8/2000 | Bhambra et al. | 101/459 |
| 6,138,567 | * | 10/2000 | Ray et al. | 101/467 |
| 6,138,568 | * | 10/2000 | McCullough et al. | 101/465 |

FOREIGN PATENT DOCUMENTS

| | | |
|---|---|---|
| 1118009 | 3/1957 | (DE) . |
| 3144657 A1 | 9/1982 | (DE) . |
| 112615 | 12/1998 | (DE) . |
| 0 028 137 | 6/1981 | (EP) . |
| 0 110 417 | 6/1984 | (EP) . |
| 0 619 524 A1 | 4/1993 | (EP) . |
| 0 620 502 A1 | 4/1993 | (EP) . |
| 0 619 525 A1 | 10/1994 | (EP) . |
| 0 653 685 A1 | 10/1994 | (EP) . |
| 0 565 006 B1 | 7/1998 | (EP) . |
| 956376 | 4/1964 | (GB) . |
| 1141556 | 1/1969 | (GB) . |
| 1196886 | 7/1970 | (GB) . |
| 1439127 | 6/1976 | (GB) . |
| 2031442 | 4/1980 | (GB) . |
| 1592281 | 7/1981 | (GB) . |

(List continued on next page.)

* cited by examiner

*Primary Examiner*—Stephen R. Funk
(74) *Attorney, Agent, or Firm*—Ratner & Prestia

(57) ABSTRACT

An improved hydrophilized substrate for planographic printing is disclosed. The substrate contains a support and a hydrophilic layer over the support. The hydrophilic layer contains titanium dioxide (titania) particles. In one embodiment, the hydrophilic layer contains a mixture of coated and uncoated titanium dioxide particles, and, optionally, alumina particles. A method for preparation of the substrate and a printing member comprising the substrate are also disclosed.

39 Claims, 2 Drawing Sheets

FOREIGN PATENT DOCUMENTS

| | | | |
|---|---|---|---|
| 2069164 | | 8/1981 | (GB) . |
| 2080964 A | | 2/1982 | (GB) . |
| 2109573 A | | 6/1983 | (GB) . |
| 2222553 A | | 3/1990 | (GB) . |
| 56-84994 | | 7/1981 | (JP) . |
| 59214651 A | | 12/1984 | (JP) . |
| 61123594 A | | 6/1986 | (JP) . |
| 63268642 | | 7/1988 | (JP) . |
| 89/01871 | | 3/1989 | (WO) . |
| 91/12140 | | 8/1991 | (WO) . |
| 94/05507 | | 3/1994 | (WO) . |
| 97/19819 | * | 6/1997 | (WO) . |
| 98/22853 | | 5/1998 | (WO) . |

HYDROPHILIZED SUBSTRATE FOR PLANOGRAPHIC PRINTING

FIELD OF THE INVENTION

This invention relates to planographic printing and provides a substrate for a planographic printing member, a printing member per se and a method of preparing a substrate for a planographic printing member. Particularly, although not exclusively, the invention relates to lithographic printing.

BACKGROUND OF THE INVENTION

PCT Publication No. WO97/19819 (Horsell) describes a method of preparing a substrate for a planographic printing plate which comprises contacting a support with a liquid comprising a sodium silicate solution in which alumina and titania are dispersed thereby to produce a hydrophilic layer over the support. In each of the examples, the ratio of the wt % of alumina to titania is 1:1. However, investigations have shown that there are significant problems with blanket piling and undesirable ink-sensitive spots associated with the use of the formulations described.

Paper used on a sheet fed offset printing press is normally smaller than the plate used to print. "Blanket piling" is the build-up of ink on the blanket within the area contacted by the plate but not by the paper. It can lead to problems over longer press runs by transferring ink to the edge of the paper being printed. In addition, the press needs to be stopped more frequently for blanket cleaning where piling is a problem. On conventional substrates, the cause of piling is usually due to poor ink/water balance, non-waterproof ink or the surface chemistry and morphology of the substrate.

Ink-sensitive spots have been observed on printing plates prepared as described in WO97/19819 after the plates have been cleaned either during or after a print run and then, subsequently, re-run on press—the spots appear once the press is restarted. Although the spots are removable by cleaning the plates for a second time, the effect is undesirable since, if the plates are not properly cleaned (as could easily happen in a commercial printing environment), the spots would result in ink being transferred to printed sheets which would, therefore, be rendered useless.

Other problems that have been identified in relation to the formulations described in WO97/19819 are associated with its application to a support. In this regard, firstly, the particulates in the formulations have a tendency to settle out of the formulations too quickly; secondly, the viscosity of the formulations is relatively low which tends to increase the formulations' instability; and, thirdly, the formulations are relatively abrasive which leads to significant wear on apparatus used to coat: them.

It is a primary object of the present invention to address the piling problem described above. It is another object to address the ink spot problem described above. It is a further object to address other problems associated with the formulations described in WO97/19819.

SUMMARY OF INVENTION

According to a first aspect of the invention, there is provided a substrate for a planographic printing member, the substrate comprising a support and a hydrophilic layer which includes a binder material having Si—O bonds and particulate material, wherein said particulate material includes less than 30 wt % of alumina and greater than 40 wt % of titania.

Advantageously, a hydrophilic layer of the type described has a lower susceptibility to both piling and ink spots compared to hydrophilic layers wherein the weight ratio of titania to alumina is 1:1, as in WO97/19819.

DETAILED DESCRIPTION OF PREFERRED EMBODIMENTS

Figure 1:
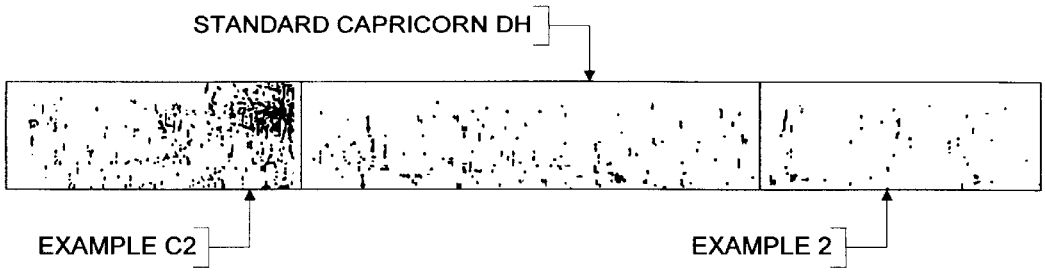
FIG. 1 illustrates a comparison of the relative amounts of ink transferred to the blanket of a printing press for the plates of Examples C2, 2 and a standard electrograined and anodized plate to illustrate the relative piling tendency of the plates.

Said binder material may be a component of a polymeric material which includes Si—O bonds. Said polymeric material may include —Si—O—Si—, especially —Si—O—Si—O—, moieties.

At least 50 wt %, suitably at least 60 wt %, preferably at least 70 wt %, more preferably at least 80 wt %, especially at least 90 wt %, most preferably at least 95 wt % of said binder material is made up of a polymeric material having Si—O bonds as described. Preferably, said binder material consists essentially of a polymeric material having Si—O bonds as described.

Said binder material may make up at least 5 wt %, preferably at least 10 wt %, more preferably at least 15 wt %, especially at least 20 wt % of said hydrophilic layer.

Said binder material may make up less than 50 wt %, preferably less than 40 wt %, more preferably less than 30 wt %, especially less than 25 wt %, of said hydrophilic layer.

Said binder material may be derived or derivable from A silicate material for example water glasses, metasilicates, orthosilicates, sesquisilicates and modified silicates such as borosilicate and phosphosilicate. Said binder material is preferably derived or derivable from a silicate solution.

Said binder material preferably includes less than 10 wt %, preferably less than 5 wt %, more preferably less than 1 wt %, organic material, for example polymeric organic material. Preferably, said binder material includes substantially no polymeric organic material.

Said particulate material is preferably dispersed in said binder material. Said particulate material is preferably substantially water insoluble. Suitably at least 30 wt %, preferably at least 40 wt %, more preferably at least 50 wt %, especially at least 60 wt % of said hydrophilic layer is composed of said particulate material. Suitably less than 90 wt %, preferably less than 85 wt %, more preferably less than 80 wt %, especially less than 75 wt % of particulate material is dispersed in said binder material.

Said particulate material may include at least 50 wt %, suitably at least 60 wt %, preferably at least 70 wt %, more preferably at least 75 wt %, especially at least 80 wt % of titania. In some cases, about 100 wt % of the particulate material may be titania. Preferably, however, less than 95 wt %, more preferably less than 90 wt %, especially less than 88 wt % of said particulate material is titania.

The ratio of the wt % of titania to binder material in said hydrophilic layer may be at least 1, suitably at least 1.5, preferably at least 2, more preferably at least 2.5. Said ratio may be less than 4.5, suitably less than 4, preferably less than 3.5, more preferably less than 3.

Said titania may have a mean particle size by mass of at least 0.05 μm, preferably at least 0.10 μm, more preferably at least 0.15 μm, especially at least 0.19 μm. The mean particle size may be less than 2 μm, suitably less than 1.5 μm, preferably less than 1 μm, more preferably less than 0.5 μm, especially less than 0.35 μm.

Where said particle material includes both titania and alumina, the mean particle size by mass of said titania is preferably less than that of alumina, preferably by at least 10%, more preferably by at least 50%.

Said titania may include an anatase titania. Said titania may include a coated titania, for example a titania provided with a coating comprising a material which is harder than the titania it coats. The coating may make up less than 5 wt %, preferably 4.5 wt % or less of the titania. Said coating may comprise alumina.

Said titania may include more than one type of titania. For example, one type may be an anatase titania, the other may be a rutile titania; and/or one type of titania may be coated and the other may be substantially non-coated.

Said particulate material may include less than 25 wt %, preferably less than 20 wt % of alumina. In some cases, the particulate material may comprise substantially no alumina. However, in embodiments where it is desired to achieve a run length normally expected where aluminum is the support, the particulate material includes alumina and, in this case, may include at least 4 wt %, preferably at least 8 wt %, more preferably at least 12 wt % alumina.

Said alumina may have a hardness of greater than 8 Modified Mohs (on a scale of 0 to 15), preferably greater than 9 and, more preferably, greater than 10 Modified Mohs. Said alumina may comprise generally spherical particles. Alternatively, said alumina may comprise flattened particles or platelets. Said alumina may have a mean particle size of at least 0.1 μm, preferably at least 0.5 μm and, more preferably at least 1 μm. Said alumina may have a mean particle size of less than 200 μm, suitably less than 100 μm, preferably less than 45 μm, more preferably less than 20 μm, especially less than 10 μm and, most preferably, less than 5 μm. The particle size distribution for 95% of particles of the alumina may be in the range 0.01 to 150 μm, preferably in the range 0.05 to 75 μm, more preferably in the range 0.05 to 30 μm. The reference to alumina includes a reference to $Al_2O_3$ per se and hydrates thereof, for example $Al_2O_3.3H_2O$. Preferably, however, said material is $Al_2O_3$ per se.

The ratio of the weight of alumina to the weight of titania in the layer may be in the range 0 to 0.5, suitably in the range 0 to 0.4, preferably in the range 0 to 0.3, more preferably in the range 0 to 0.25, especially in the range 0 to 0.2. The ratio may be at least 0.05, suitably at least 0.08, preferably at least 0.1, more preferably at least 0.12, especially at least 0.14.

Said particulate material in said hydrophilic layer may include one or more other particulate materials. Suitably, less than 30 wt %, preferably less than 20 wt %, more preferably less than 10 wt %, especially less than 5 wt % of each other particulate material is included in said hydrophilic layer. Preferably, the total of other particulate materials in said hydrophilic layer is less than the values indicated.

The total of other particulate materials is suitably in the range 0–25 wt %, preferably 0–10 wt %, more preferably 0–5 wt %, especially 0–3 wt % of the total particulates in said hydrophilic layer.

Where other particulate materials are included as described, such materials may be organic or inorganic. Organic particulate materials may be provided by latexes or organosols or polymeric balls, such as of nylon. Inorganic particulate materials may be selected from silica, silicon carbide, zinc sulphide, zirconia, barium sulphate, talcs, aluminosilicates, clays (e.g. Kaolin), lithopone and calcium carbonate. Preferred other particulate materials are barium sulphate, zinc sulphide, calcium carbonate and aluminosilicates.

Where said particulate material includes other particulates as described, the mean particle size by mass of such particulates is preferably less than 10 μm, more preferably less than 5 μm, especially 3 μm or less.

The sum of the amounts of titania and alumina may represent at least 75 wt %, suitably at least 85%, preferably at least 90 wt %, more preferably at least 95 wt %, especially at least 98 wt % of the weight of said particulate material in said hydrophilic layer.

Said hydrophilic layer preferably includes a surfactant as hereinafter described. The inclusion of a surfactant has been found to reduce the amount of staining of the hydrophilic layer by dye in the image layer. Such staining may be visible when a positive or negative working image layer is removed on development.

Said hydrophilic layer may have an average thickness of less than 100 μm, suitably less than 50 μm, preferably less than 20 μm, more preferably less than 10 μm, especially less than 5 μm. In some cases, the layer may have an average thickness of less than 3 μm. Said hydrophilic layer may have an average thickness of greater than 0.1 μm, suitably greater than 0.3 μm, preferably greater than 0.5 μm, more preferably greater than 1 μm.

The Ra of the hydrophilic layer may be measured using a Talysurf Plus unit fitted with a 112/2564-430 head, supplied by Rank Taylor Hobson Inc. of Leicester, U.K. The Ra may be at least 0.2 μm, suitably at least 0.25 μm, preferably at least 0.3 μm. The Ra may be less than 1.5 μm, suitably less than 1 μm, preferably less than 0.8 μm, more preferably less than 0.7 μm, especially less than 0.6 μm, most preferably less than 0.5 μm.

Said hydrophilic layer may include 1 to 20 g of material/$m^2$ of substrate. Preferably said layer includes 3 to 20 g, more preferably 5 to 18 g, of material per meter squared of substrate. Most preferably, said layer includes 6 to 14 g of material/$m^2$.

Said support may comprise a metal layer. Preferred metals include aluminum, zinc and titanium, with aluminum being especially preferred. Said support may comprise an alloy of the aforesaid metals. Other alloys that may be used include brass and steel, for example stainless steel.

Said support may comprise a non-metal layer. Preferred non-metal layers include layers of plastic, paper or the like. Preferred plastic include polyester, especially polyethylene terephthlate.

Said support may include one or a plurality of layers. Where the support comprises a plurality of layers, it may comprise a plastic, paper or textile layer and another layer. Said other layer may be a metal layer, suitably of a type described above. In this case, said support may comprise a metal to plastic or paper laminate; or metal may be applied by other means to plastic or paper, for example by sputtering or the like.

Said support may be any type of support used in printing. For example, it may comprise a cylinder or, preferably, a plate.

Said support may be pretreated prior to the application of said hydrophilic layer by one or more conventional methods used in the surface treatment of aluminum or other supports, for example caustic etch cleaning, solvent etching, acid cleaning, brush graining, mechanical graining, slurry graining, sand blasting, abrasive cleaning, electrocleaning, solvent degreasing, ultrasonic cleaning, alkali non-etch cleaning, primer coating, flame treatment, grit/shot blasting and electrograining. Details of such methods are provided in: "The surface treatment and finishing of aluminium and its alloys" S. Wernick, R. Pinner and P. G. Sheasby published by Finishing Publication Ltd., ASM International, $5^{th}$ edition 1987.

Said support may be provided with a roughened surface over which the hydrophilic layer may be provided. Alternatively, a subbing layer or layers may be provided over the support. In another example, said support may be subjected to a Corona treatment.

A subbing layer may include a polymeric or polymerizable material which may be organic or inorganic. Said layer may comprise a proteinaceous material, for example gelatin or a resin which may include or be prepared using monomers selected from vinyl moieties, such as styrene; alkenyl moieties such as butadiene; and acid moieties such as acrylic. Said resin may include ester or carboxylic acid functional groups.

According to a second aspect of the present invention, there is provided a printing member comprising a substrate according to said first aspect and an image layer.

The term "image layer" includes a layer that can subsequently be partially removed in order to define areas to be printed and includes a layer which already defines areas to be printed. Said image layer may include one or a plurality of layers.

Said image layer is preferably arranged to be removed during or after exposure to radiation, in order to define areas to be printed.

Said hydrophilic layer is preferably arranged between said support and said image layer. Said image layer preferably contacts said hydrophilic layer.

The image layer may be provided over the entire surface of said hydrophilic layer. It may comprise any known photosensitive material whether arranged to form a positive or negative plate. Examples of photosensitive materials include diazonium/diazide materials, polymers which undergo depolymerization or addition photopolymerization and silver halide gelatin assemblies. Examples of suitable materials are disclosed in GB 1 592 281, GB 2 031 442, GB 2 069 164, GB 2 080 964, GB 2 109 573, EP 0 377 589, U.S. Pat. Nos. 4,268,609 and 4,567,131. Preferably, the light sensitive material is quinone diazide material.

Alternatively, said image layer in the form of a desired image for use in planographic printing may be deposited over said hydrophilic layer by a deposition process such as ink jet or laser ablation transfer. An example of the latter is described in U.S. Pat. No. 5,171,650.

According to a third aspect of the invention, there is provided a printing member according to said second aspect which includes image and non-image areas.

According to a fourth aspect of the present invention, there is provided a method of preparing a substrate for a planographic printing member including the step of forming a hydrophilic layer on a support by contacting the support with a fluid comprising a silicate solution in which particulate material is dispersed, wherein said particulate material includes less than 30 wt % of alumina and greater than 40 wt % of titania.

Said silicate solution may comprise a solution of any soluble silicate including compounds often referred to as water glasses, metasilicates, orthosilicates and sesquisilicates. Said silicate solution may comprise a solution of a modified silicate for example a borosilicate or phosphosilicate.

Said silicate solution may comprise one or more, preferably only one, metal or non-metal silicate. A metal silicate may be an alkali metal silicate. A non-metal silicate may be quaternary ammonium silicate.

Said silicate solution may be formed from silicate wherein the ratio of the number of moles of Si species, for example $SiO_2$, to the number of moles of cationic, for example metal species is in the range 0.25 to 10, preferably in the range 0.25 to about 6, more preferably in the range 0.5 to 4.

Said silicate is preferably alkali metal silicate. In this case, the ratio of the number of moles of $SiO_2$ to the number of moles $M_2O$ in said silicate, where M represents an alkali metal may be at least 0.25, suitably at least 1, preferably at least 2, more preferably at least 2.5, especially at least 3. Said ratio may be less than 6, preferably less than 5, more preferably less than 4, especially less than 3.5.

Preferred alkali metal silicates include lithium, sodium and potassium silicates, with lithium and/or sodium silicate being especially preferred. A silicate solution comprising only sodium silicate is most preferred.

Said fluid may comprise 2 to 30 wt % of silicate (e.g. dissolved sodium silicate solid), preferably 5 to 20 wt %, more preferably 8 to 16 wt %. The fluid may be prepared using 10 to 60 wt %, preferably 30 to 50 wt %, more preferably 35 to 45 wt % of a silicate solution which comprises 30 to 40 wt % silicate. Said fluid may include 5 to 60 wt % of particulate material. Preferably, the fluid includes 10 to 50 wt %, more preferably 15 to 45 wt %, especially 20 to 40 wt % of particulate material.

The ratio of the weight of particulate material to the weight of solubilized Si—O containing species in said fluid is preferably at least 2, more preferably at least 2.5, especially at least 3. Said ratio may be less than 5, preferably less than 4.5, more preferably less than 4, especially less than 3.5.

The ratio of the weight of particulate material to the weight of dissolved silicate solids (e.g. dissolved alkali metal silicate) in said fluid may be at least 1, suitably at least 1.5, preferably at least 2, more preferably at least 2.25, especially at least 2.4. Said ratio may be 4 or less, suitably 3.5 or less, preferably 3 or less, more preferably 2.75 or less, especially 2.6 or less.

Said fluid may include more than 20 wt %, suitably more than 30 wt %, preferably more than 40 wt %, more preferably more than 45 wt %, especially more than 50 wt %, water (including water included in said silicate solution). Said fluid may include less than 80 wt %, preferably less than 70 wt %, more preferably less than 65 wt %, especially less than about 61 wt % water.

The pH of said fluid may be greater than 9.0, is preferably greater than 9.5 and, more preferably, is greater than 10.0. Especially preferred is the case wherein the pH is greater than 10.5. The pH is suitably controlled so that the silicate remains in solution and does not form a gel. A gel is generally formed when the pH of a silicate solution falls below pH9. The pH of said fluid is preferably less than 14, more preferably less than 13.

Said fluid preferably includes a surfactant. Said surfactant is preferably anionic. Preferred surfactants are alkyl sulphate surfactants.

In addition to a reduction in dye staining as aforesaid, the inclusion of a surfactant may reduce settling of the formulation prior to coating and increase the viscosity of the formulation.

Said formulation may include 0 to 1 wt %, suitably 0 to 0.8 wt %, preferably 0 to 0.6 wt %, more preferably 0 to 0.4 wt %, especially 0 to 0.3 wt % of surfactant.

Said fluid may have a viscosity of less than 100 centipoise when measured at 20° C. and a shear rate of $200s^{-1}$ using a Mettler Rheomat 180 Viscometer incorporating a double gap measuring geometry. Preferably, said viscosity is less than 50 centipoise, more preferably less than 30 centipoise when measured as aforesaid. Especially preferred is the case wherein the viscosity is less than 20 centipoise.

Said fluid may be applied to both sides of said support in order to form a hydrophilic layer on both sides. A support with such a layer on both sides may be used to prepare a double-sided lithographic plate. Alternatively, if such a support is used for a single-sided plate, the side of the plate which does not carry an image layer may be protected by the hydrophilic layer. Said fluid is preferably applied to only one surface of said support.

Said fluid may be applied to said support to form a hydrophilic layer having an average thickness after drying, of less than 20 μm, preferably less than 10 μm and, more preferably, less than 5 μm. Especially preferred is the case wherein the average thickness is less than 3 μm.

The method preferably includes the step of providing suitable conditions for the removal of water from the fluid after it has been applied to the support. Suitable conditions may involve passive or active removal of water and may comprise causing an air flow over the support and/or adjusting the humidity of air surrounding the support. Preferably, the method includes the step of arranging the support in a heated environment. The support may be placed in an environment so that its temperature does not exceed 230° C., preferably does not exceed 200° C. and, more preferably, does not exceed 175° C. Especially preferred is the case wherein the support temperature does not exceed 150° C.

The support may be arranged in the heated environment for less than 180 seconds, preferably less than 120 seconds, and more preferably, less than 100 seconds.

The invention extends to a method of preparing a printing member comprising applying an image layer over a substrate prepared according to said fourth aspect.

Any feature of any aspect of any invention or embodiment described herein may be combined with any feature of any aspect of any other invention or embodiment described herein.

Figure 2:
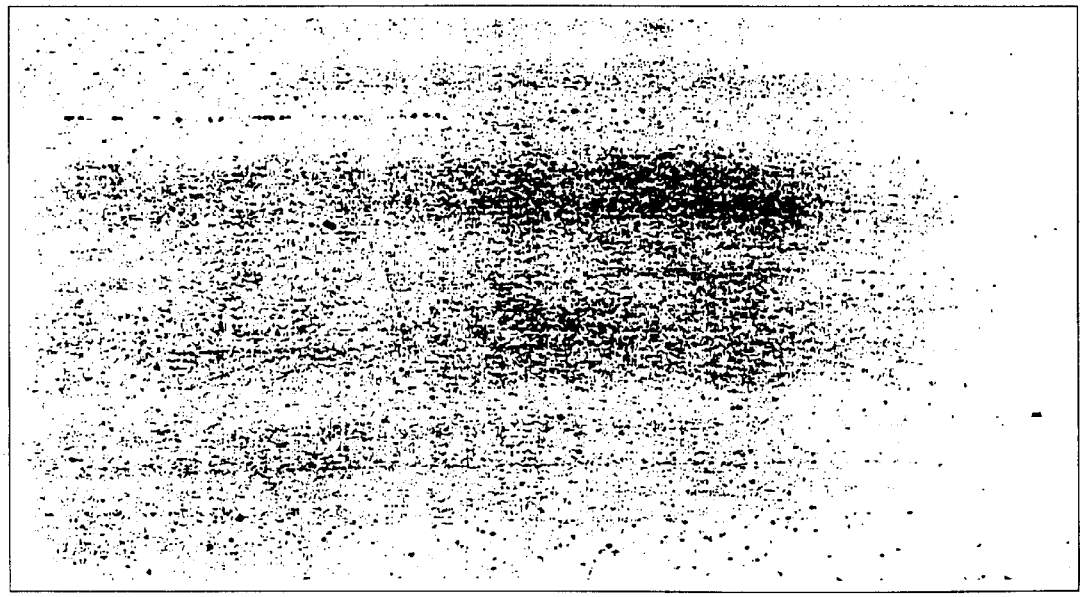
FIG. 2 is a print taken from a substrate prepared as described in Example 7 to show its susceptibility to ink-sensitive spots.
Figure 3:
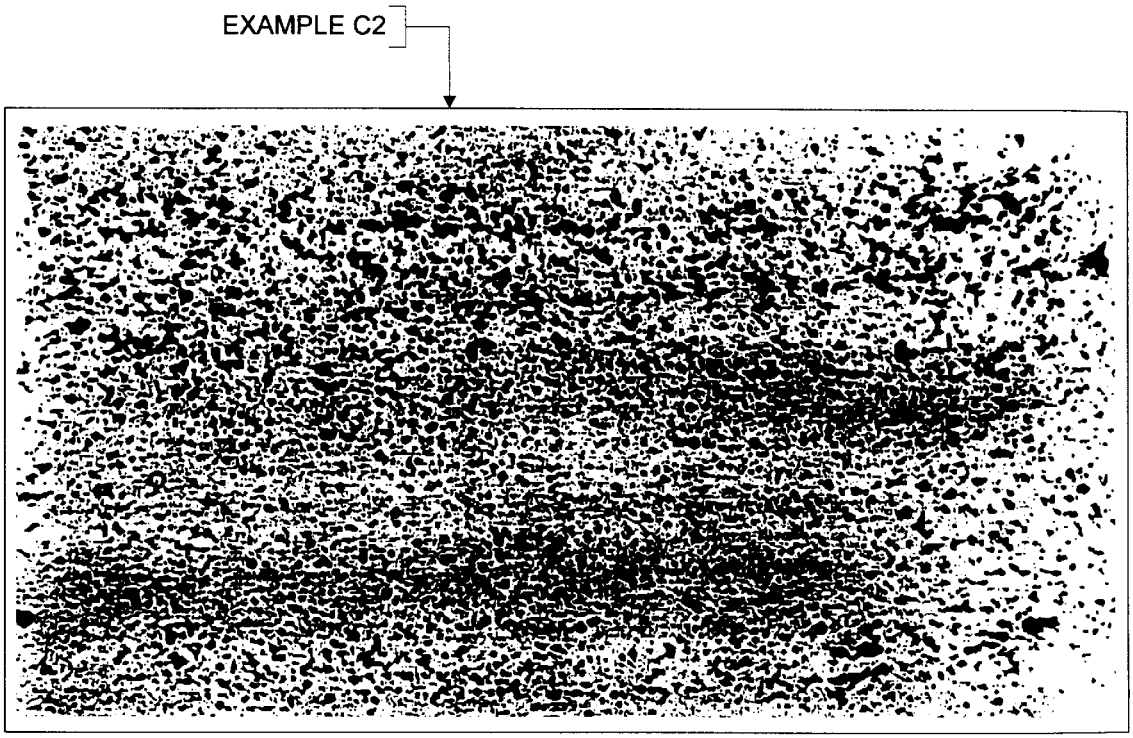
FIG. 3 is a print taken from a substrate prepared as described in Example C4 to show its susceptibility to ink-sensitive spots.

Specific embodiments of the invention will now be described, by way of example, with reference to the accompanying figures, wherein:

FIG. 1 is a comparison of the relative amounts of ink transferred to the blanket of a printing press for the plates of Examples C2, 2 and a standard electrograined and anodized plate (CAPRICORN® DH plate) to illustrate the relative piling tendency of the plates;

FIG. 2 is a print taken from a substrate prepared as described in Example 7 to show its susceptibility to ink-sensitive spots; and FIG. 3 is a print taken from a substrate prepared as described in Example C4 to show its susceptibility to ink-sensitive spots.

EXAMPLES

The following are referred to hereinafter:

Crystal 75—sodium silicate solution having a ratio $SiO_2$:$Na_2O$ in the range 3.17 to 3.45 (average about 3.3); a composition of 27.1–28.1 wt % of $SiO_2$, 8.4–8.8 wt % $Na_2O$, with the balance being water; and a density of about 75 Twaddel ($^0$TW), equivalent to 39.5 Baumé (°Bé ) and a specific gravity of 1.375 obtained from Crossfield Ltd of Warrington, U.K.

TI-PURE ® R900—a rutile titanium dioxide pigment manufactured by the chloride process, having a minimum of 94 wt % of titanium dioxide and an alumina coating (4.5 wt % maximum), a particle mean diameter by mass of 0.28 μm and being obtained from Marlow Chemical Company Ltd, Westerham, Kent, U.K.

Hombitan LW—micronized anatase titanium dioxide having a mean diameter by mass of 0.2 μm, obtained from Hubron Sales Ltd of Manchester, U.K.

MICROGRIT® C3 alumina powder—$Al_2O_3$ powder comprising alumina (99.6%) in the shape of hexagonal platelets; the mean particle size is 3 μm; and the hardness of the particles is 9 Mohs (on a 0–10 hardness scale) obtained from Peter Wolters UK Ltd, London, UK.

Surfaron A6008—Sodium 2-ethyl-hexyl sulphate anionic surfactant, obtained from Protex of Leeds, U.K.

Aura processor—an Aura 650 Plate Processor available from Kodak Polychrome Graphics, Leeds. U.K.

CAPRICORN® DH—a positive-working lithographic coating available from Kodak Polychrome Graphics, Leeds, U.K.

Montakop 95 M light frame—a light frame available from Siegfried Theimer GmbH, Obersotzbach, Germany.

Goldstar developer—a positive plate developer available from Kodak Polychrome Graphics, Leeds. U.K.

Multigum—a gum available from Kodak Polychrome Graphics, Leeds, U.K.

Heidelberg SpeedMaster 52—a printing press obtained from Heidelberg, Leeds, U.K.

CAPRICORN® DH Plate—a positive-working printing plate available from Kodak Polychrome Graphics, Leeds, U.K.

Emerald Fount—a fount available from Kodak Polychrome Graphics, Leeds, U.K.

Geneva Alcolor Black—a black printing ink available from Gibbons Inks, Leeds, U.K.

Due Laser Brilliance paper—a paper available from Federal Tait Paper Products, U.K.

Rapid Ink—a commercially available ink, available from Kodak Polychrome Graphics, Leeds, U.K.

Hydrokleen—a press cleaning formulation, available from Kodak Polychrome Graphics, Leeds. U.K.

A. Preparation of Coating Formulations

Coating formulations of Examples 1 to 5, C1 and C2 were prepared by mixing, using a high shear mixer, the components listed in Table 1, in the order given.

TABLE 1

| Material (weights in grams) | Example No 1 | C1 | 2 | 3 | 4 | 5 | C2 |
|---|---|---|---|---|---|---|---|
| Deionized water | 47.98 | 48.29 | 47.98 | 59.29 | 47.98 | 47.99 | 59.59 |
| TI-PURE ® R900 pigment | 20.67 | — | 20.67 | 18.37 | 30.48 | 24.03 | — |
| Hombitan LW | 20.67 | 24.03 | 20.67 | 18.37 | 9.13 | 24.03 | 21.36 |
| MICROGRIT ® C3 alumina powder | 6.73 | 24.03 | 6.73 | 5.98 | 8.46 | — | 21.36 |
| Crystal 75 | 53.65 | 53.65 | 53.65 | 47.69 | 53.65 | 53.65 | 47.69 |
| Surfaron A6008 | — | — | 0.30 | 0.30 | 0.30 | 0.30 | — |

Where an example number is prefixed with a letter "C", it is a comparative example as discussed hereinafter.

B. Assessment of Coating Formulations

Assessment 1—Settling tendency of formulations.

Approximately 50 mL of selected formulations were pipetted into a 100 mL measuring cylinder. The formulations were allowed to stand for a period of 24 hours and then inspected to determine the extent of settling over the standing period by measuring the volume of clear liquor above the bulk of the formulation and expressing this as a percentage of the overall volume. Results are provided in Table 2.

TABLE 2

| Formulation Example No | Solids Content | % settle |
|---|---|---|
| C2 | 40% | 34 |
| 3 | 40% | 31 |
| C1 | 45% | 30 |
| 2 | 45% | 24 |
| 4 | 45% | 23 |
| 5 | 45% | 16 |

A comparison of Example numbers C2 and 3 shows that Example 3, which includes the surfactant, has a reduced tendency to settle. Similarly, a comparison of Examples 2 and 4 with Example C1 shows that the formulations with the surfactant have a reducing settling tendency. It will also be noted that formulations having a higher solids content settle more slowly.

Assessment 2—Viscosity of formulations.

Viscosity measurements were taken at 20° C. for Examples 3 and C2 using a Mettler Rheomat 180 Viscometer incorporating a double gap measuring geometry. Measurements were taken over different spindle velocities. Results are provided in Table 3.

TABLE 3

| Formulation Example No | Viscometer Spindle Velocity/r.p.m 300 | 600 | 900 | 1200 |
|---|---|---|---|---|
| | Viscosity/cp | | | |
| C2 | 10 | 9 | 10 | 11 |
| 3 | 13 | 10 | 11 | 13 |

The results show that the viscosity is higher for Example 3, compared to Example C2. As a result, the stability of the coating of Example 3 may be improved compared to that of Example C2.

Assessment 3—abrasivity of formulations.

The relative wear brought about by use of the formulations was assessed by a method using standard test balls held in a PTFE unit through which a spindle drove a mild steel test disc at a required speed. The action of the abrasive test formulations produced wear on both the test disc and balls, the size of the wear scar on the latter being the value measured since the curvature of the test ball provided a much greater sensitivity to small amounts of wear. Results are provided in Table 4.

TABLE 4

| Formulation Example No | Mean Volume ($mm^3$) | Mean Wear Volume ($mm^3$) |
|---|---|---|
| C1 | 1.85 | 1.96 |
| | 2.21 | |
| | 1.81 | |
| 2 | 1.26 | 1.45 |
| | 1.86 | |
| | 1.24 | |
| 4 | 0.97 | 0.91 |
| | 0.88 | |
| | 0.89 | |
| 5 | 0.13 | 0.09 |
| | 0.04 | |

The results show that formulations 2, 4 and 5 have a reduced abrasivity compared to formulation C1 which may mean that equipment used to coat the formulations 2, 4 and 5 may wear less quickly and, therefore, would not need to be replaced as frequently, compared to if formulation C1 was used.

C. Press Performance

Preparation of Printing Plates

Example 6

A 0.3 mm gauge aluminum alloy sheet of designation AA1050 was cut to a size of 500 mm by 250 mm and degreased by immersion in a 1 wt % aqueous solution of sodium hydroxide. The coating formulation of Example 1 was then applied to the aluminum sheet using a wire wound bar to achieve a dry film weight of about 6 $g/m^2$. The coating was dried in a convection oven at 130° C. for 80 seconds and then immersed in aluminum sulphate solution (10% w/w in distilled water at 40° C.) for 120 seconds using an Aura processor to neutralize the alkaline surface and to seal the surface of the substrate. The substrate was then rinsed with tap water and dried before being coated with CAPRICORN® DH using a wire wound bar to achieve a dry film weight of about 2 $g/m^2$. After coating, the plate was dried at 130° C. for 80 seconds in a convection oven. The printing plate thus produced was imaged using a Montakop 95M light frame for 101 exposure units and developed in Goldstar developer at 20° C. for 60 seconds using a developing pad. After rinsing with tap water, the plate was squeezed and gummed with Multigum prior to testing.

Comparative Example C3

A plate was prepared as described in Example 6, except that the coating formulation of Example C1 was used instead of that of Example 1.

Assessment of Printing Plates

Assessment 1—Piling tendency

The plates of Examples 6 and C3 were tested on a Heidelberg SpeedMaster 52 printing press (using Emerald fount, Geneva Alcolor Black ink and Duo Laser Brilliance Gsm80, long grain paper) alongside a standard CAPRICORN® DH plate which had been imaged and developed as described in Example 6.

Approximately 2000 impressions were carried out on each of the three plates and, thereafter, the region outside of the paper was inspected and a piece of printing paper was placed on the blanket so that a proportion of the ink deposited thereon was absorbed. This gave an indication of the ink build up on the blanket (i.e. blanket piling). A comparison (see FIG. 1) between the plates on press clearly showed that less ink had built up for the plate of Example 6, compared to that of Example C3; furthermore, the build up for the plate of Example 6 was comparable to that of the commercial CAPRICORN® DH plate.

As a result of the reduction in piling for the plate of Example 6, a printer would need to stop the press less frequently than if the plate of Example C3 was used.

Assessment 2—Ink-Sensitive Spots

The occurrence of ink-sensitive spots has been reproduced in the laboratory by preparing and testing a substrate as described in Example 7.

Example 7

A substrate of size approximately 200 mm×150 mm was prepared partly as described in Example 6. However, after the treatment with aluminum sulphate solution, 20 mL of a 5% w/w aqueous solution of sodium chloride was applied to the surface of the substrate using a cotton wool swab and left for 15 minutes. The 20 ml of solution is sufficient to completely wet the substrate. During this period, the substrate was re-wetted to prevent it drying out completely. Thereafter, the substrate was rinsed thoroughly with water and then any excess water was removed using a squeegee. An inking solution containing Rapid Ink (50 g), Hydrokleen (100 g) and Emerald fount (2 drops) was then applied to the substrate surface (to mimic the cleaning action on press) and left for a period of 5 minutes. Thereafter, solution was re-applied for two further periods of 5 minutes so the total contact time of solution with the substrate was 15 minutes. The inking solution was removed by rinsing with water and the substrate inspected for ink-sensitive spots.

Example C4

A substrate was prepared as described in Example 7, except that the coating formulation of Example C1 was used instead of that of Example 1.

Results

Referring to FIGS. 2 and 3, the differences between the substrates of respective Examples 7 and C4, after cleaning on press, are readily apparent—clearly the substrate of Example C4 is inferior to that of Example 7.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A substrate for a planographic printing member, the substrate comprising a support and a hydrophilic layer over the support;

in which:

the hydrophilic layer comprises a binder material having —Si—O—Si—O— moieties and a particulate material;

the particulate material comprises less than 20 wt % of alumina and greater than 40 wt % of titania;

the titania and the alumina comprise at least 75 wt % of the particulate material;

the binder material comprises substantially no polymeric organic material; and the particulate material comprises at least 12% alumina.

2. The substrate of claim 1 the ratio of the alumina to the titania is 0 to 0.25.

3. The substrate of claim 1 wherein said binder material makes up at least 15 wt % of said hydrophilic layer.

4. The substrate of claim 1 wherein at least 30 wt % of said hydrophilic layer is composed of said particulate material.

5. The substrate of claim 1 wherein said particulate material includes at least 70 wt % of titania.

6. The substrate of claim 1 wherein the ratio of the wt % of titania to binder material in said hydrophilic layer is at least 1.

7. The substrate of claim 1 wherein the mean particle size by mass of said titania is less than 2 $\mu$m.

8. The substrate of claim 1 wherein said hydrophilic layer has an average thickness of less than 100 $\mu$m.

9. The substrate of claim 1 wherein the Ra of the hydrophilic layer is at least 0.2 $\mu$m and less than 1.5 $\mu$m.

10. The substrate of claim 1 additionally comprising an image layer over the hydrophilic layer.

11. The substrate of claim 10 in which the image layer comprises image and non-image areas.

12. A substrate for a planographic printing member, the substrate comprising:

a support; and a hydrophilic layer over said support:

in which:

the hydrophilic layer comprises a binder material and a particulate material;

the binder material comprises at least 50% of a polymeric material that has Si—O bonds;

the particulate material comprises a first type of titanium dioxide particles and a second type of titanium dioxide particles;

the first type of titanium dioxide particles are coated with a material that is harder than the first type of titanium dioxide particles; and the second type of titanium dioxide particles are substantially non-coated.

13. The substrate of claim 12 in which the first type of titanium dioxide particles are coated with a coating comprising alumina.

14. The substrate of claim 13 in which the first type of titanium dioxide particles are rutile titanium dioxide particles and the second type of titanium dioxide particles are anatase titanium dioxide particles.

15. The substrate of claim 14 in which the particulate material additionally comprises alumina particles.

16. The substrate of claim 15 in which the binder material comprises at least 10 wt % and less than 40 wt % of the hydrophilic layer and the particulate material comprises at least 40 wt % and less than 90 wt % of the hydrophilic layer.

17. The substrate of claim 16 in which the binder material comprises at least 95 wt % of the polymeric material having Si—O bonds.

18. The substrate of claim 17 in which the binder material consists essentially of the polymeric material having Si—O bonds.

19. The substrate of claim 18 in which the polymeric material comprises —Si—O—Si—O— moieties.

20. The substrate of claim 19 in which the binder material comprises substantially no polymeric organic material.

21. The substrate of claim 15 in which the titanium dioxide particles and the alumina particles together comprise at least 75 wt % of the particulate material in the hydrophilic layer.

22. The substrate of claim 21 in which the titanium dioxide particles comprise more than 50 wt % and less than 95 wt % of the particulate material and the alumina particles comprise less than 25 wt % and more than 4 wt % of the particulate material.

23. The substrate of claim 22 in which the binder material comprises at least 10 wt % and less than 40 wt % of the hydrophilic layer and the particulate material comprises at least 40 wt % and less than 90 wt % of the hydrophilic layer.

24. The substrate of claim 23 in which the mean particle size by mass of the titanium dioxide particles is at least 10% less than the mean particle size by mass of the alumina particles.

25. The substrate of claim 24 in which the binder material comprises at least 15 wt % and less than 30 wt % of the hydrophilic layer and the particulate material comprises at least 50 wt % and less than 85 wt % of the hydrophilic layer.

26. The substrate of claim 25 in which the binder material comprises at least 95 wt % of the polymeric material having Si—O bonds.

27. The substrate of claim 26 in which at least 70 wt % of the particulate material is titanium dioxide particles.

28. The substrate of claim 26 in which the mean particle size by mass of the titanium dioxide particles is at least 50% less than the mean particle size by mass of the alumina particles.

29. The substrate of claim 28 in which the mean particle size by mass of the titanium dioxide particles is less than 2 $\mu$m.

30. The substrate of claim 29 in which the binder material comprises at least 95 wt % of the polymeric material having Si—O bonds.

31. The substrate of claim 30 in which the polymeric material comprises —Si—O—Si—O— moieties.

32. The substrate of claim 31 in which the binder material comprises substantially no polymeric organic material.

33. The substrate of claim 29 in which the binder material consists essentially of the polymeric material having Si—O bonds.

34. The substrate of claim 12 additionally comprising an image layer over the hydrophilic layer, the image layer comprising a photosensitive material.

35. The substrate of claim 34 in which the particulate material additionally comprises alumina particles.

36. The substrate of claim 35 in which the first type of titanium dioxide particles are coated with a coating comprising alumina.

37. The substrate of claim 36 in which the first type of titanium dioxide particles are rutile titanium dioxide particles and the second type of titanium dioxide particles are anatase titanium dioxide particles.

38. The substrate of claim 37 in which:

the binder material comprises at least 10 wt % and less than 40 wt % of the hydrophilic layer and the particulate material comprises at least 40 wt % and less than 90 wt % of the hydrophilic layer;

the binder material comprises at least 95 wt % of the polymeric material having Si—O bonds;

the binder material comprises substantially no polymeric organic material;

the mean particle size by mass of the titanium dioxide particles is at least 10% less than the mean particle size by mass of the alumina particles;

the titanium dioxide particles comprise more than 50 wt % and less than 95 wt % of the particulate material and the alumina particles comprise less than 25 wt % and more than 4 wt % of the particulate material; and the mean particle size by mass of the titanium dioxide particles is less than 2 $\mu$m.

39. The substrate of claim 38 in which the photosensitive material is a quinone diazide material.

* * * * *